United States Patent [19]

Weisner et al.

[11] Patent Number: 4,563,252

[45] Date of Patent: Jan. 7, 1986

[54] MAKING A WAVE GUIDE

[75] Inventors: Eike Weisner, Windeck; Werner Sczepaniak, Eitorf; Paul Thiele, Laatzen; Detlef Block, Hanover; Karl-Heinz Reimann, Langenhagen, all of Fed. Rep. of Germany

[73] Assignee: Kabelmetal Electro GmbH, Hanover, Fed. Rep. of Germany

[21] Appl. No.: 582,441

[22] Filed: Feb. 22, 1984

[30] Foreign Application Priority Data

Feb. 22, 1983 [DE] Fed. Rep. of Germany ..... 3306017

[51] Int. Cl.[4] ..... C25D 1/02; C25D 17/12

[52] U.S. Cl. ..... 204/9; 204/281

[58] Field of Search ..... 204/9, 281

[56] References Cited

U.S. PATENT DOCUMENTS

| | | | |
|---|---|---|---|
| 2,137,806 | 11/1938 | Paige | 204/9 |
| 2,793,989 | 5/1957 | Goodman | 204/9 |
| 3,487,539 | 1/1970 | Dugan | 204/9 |

*Primary Examiner*—T. M. Tufariello

*Attorney, Agent, or Firm*—Ralf H. Siegemund

[57] ABSTRACT

A wave guide is made through electrolytically depositing metal on a die and template member which is constructed so that certain fittings can be fastened thereto which will become embedded in parts in the wall of the guide wave made through the electrolytic deposition process. The fastening is made in a releasable manner so that the die can be reused.

11 Claims, 4 Drawing Figures

Fig. 1
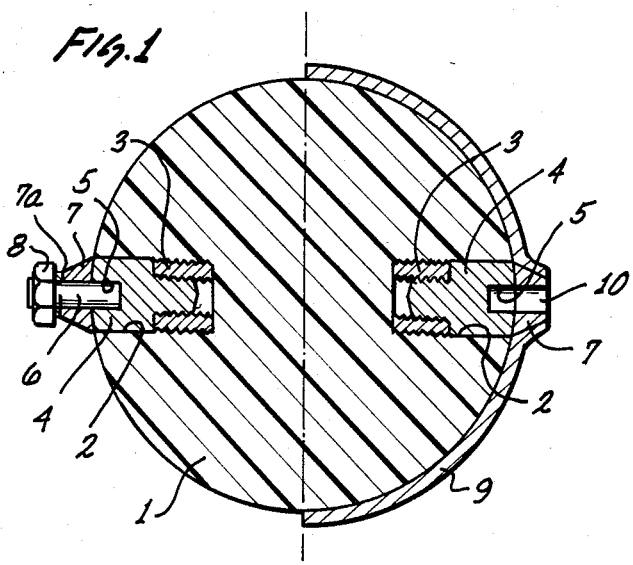
Fig. 2
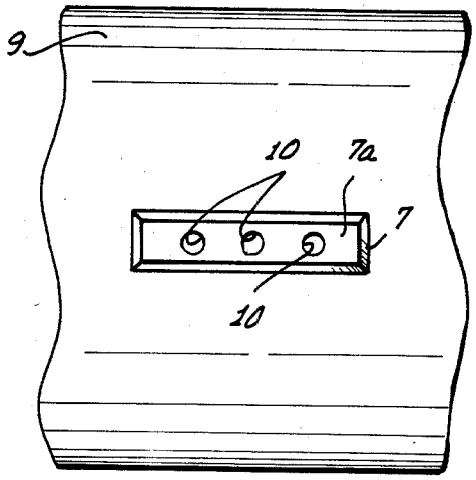
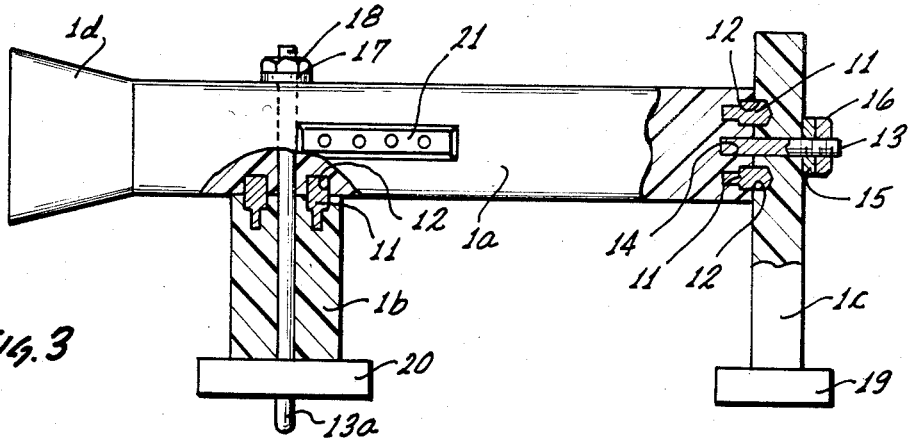
Fig. 3
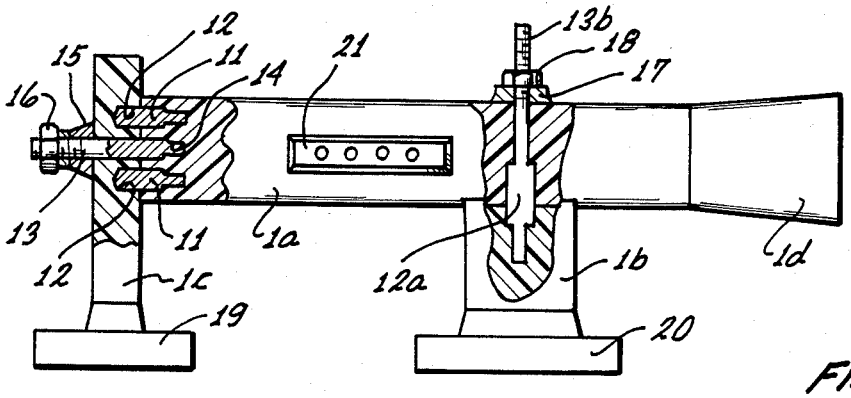
Fig. 4

MAKING A WAVE GUIDE

BACKGROUND OF THE INVENTION

The present invention relates to the making of a wave guide conductor which includes elements projecting into the interior of such a conductor such as short-circuiting pins, trimming screws, and the like, whereby particularly the adjustment and positioning of such projecting elements is determined first and the attained position is then retained through appropriate securing steps such as soldering.

The U.S. Pat. No. 3,864,688 discloses a wave guide constructed as a tube and having two inputs separated axially from each other for feeding electromagnetic waves into the interior of the wave guide. In order to rotate one of these waves by 90°, the patent suggests that a plurality of short-circuiting pins are inserted in the wall. Such a wave guide has been manufactured in the past in that feeds for the short-circuiting pins were machined into the tube and the pins were subsequently fitted therein. This procedure is disadvantaged by the fact that it is not sufficiently accurate for many instances of wave guide construction. Moreover, it was found that many parts made rather tediously in such a manner had to be discarded subsequently anyway.

DESCRIPTION OF THE INVENTION

It is an object of the present invention to provide a new and improved method for making a wave guide in which certain components are provided for projecting into the interior of the wave guide with very accurate relative positioning in relation to each other, whereby moreover the method is to be carried out in an economical fashion.

In accordance with the preferred embodiment of the present invention, it is suggested to proceed as follows. A template or master die is provided in which the seats to be made are represented in the form of metallic inserts (fittings) having suitable bores. The surface of this die or template is rendered electrically conductive and inserted into an electrolytic bath wherein it is connected to serve as a cathode for electroplating metal thereon whereby the added metallic parts become plated into the hollow conductor wall. Subsequently, the die is removed from the wave guide as made and the particular components which are to project into the interior of the wave guide are now inserted into these seats and secured thereto. They are now positioned as accurately as one can establish the seats in the master die and the accuracy thereof is, of course, determined by the accuracy of the template and die member employed in the process. This way, one reproduces wave guides with reproducible properties and they do not require subsequent finishing work, so that testing and trimming and other adjustment operations can be reduced to a minimum or may, in parts, be superfluous.

In accordance with a further feature of the invention, the metallic parts (fittings) which are to receive those parts that will project into the interior of the wave guide tube to be made, are fastened by pins, bolts or the like in that they are inserted into the surface of the die and template member through suitable guidance or positioning elements therein. These pins and bolts now secure these inserted fittings to the die, so that the inserts will become accurately positioned in the wave guide to be made, and these inserts will be accurately positioned seats for pins etc., later inserted in the seats as components for the wave guide. Due to an accurate fit, the parts that are to project into the interior of the wave guide will not shift during subsequent operations.

In furtherance of the invention, it is suggested to take particular precautions with regard to the point that surface portions of inserts which are facing away from the respective interfacing surfaces between the fittings and the die surface should be covered with an electrically nonconductive material. The purpose thereof is that during the electrolytic procedure, metal should not be deposited on these parts. Therefore, any deposition will occur here on electrically nonconductive material and will be removed therewith subsequently.

In order to avoid that electrolytic fluid can penetrate any gaps between any metallic fitting and the die member, it is suggested that the insert parts are firmly clamped to the surface of the die and template manner. This particular step avoids any difficulties that may be encountered otherwise with regard to the removal of the die and template member from the completed wave guide.

It is of particular advantage generally to thread threaded bolts into appropriately threaded bores in the surface of the die and template member so that the metallic inserts which are later to hold the parts which will protrude into the wave guide interior can be placed onto these threaded bolts and clamped thereto, e.g. by means of a threaded nut to thereby attach them firmly to the surface of the die and template member. The penetration of electrolytic fluid can be avoided with advantage in that the surface of the metallic insert (holder) parts facing the die and template member match the surface of that member to a very high degree so that the various parts abut in a planar configuration. The metallic insert parts should have a cross section which is nearly trapezoidal, whereby the larger ones of the two parallel or near parallel sides is affixed to the die and template member. This way, it is insured that the metallic part that is to be inserted into the wave guide member as a holder will be secured thereto without the formulation of hollows, cavities or other defects.

The invention, moreover, refers specifically to the construction and configuration of the die and template member as an integral part for carrying out the method. It is particularly suggested here that those components of the die member generally which are to mount the components which in turn will project into the interior of the wave guide are inserted in the die member through suitable positioning or mounting elements and thus mounting elements will not project beyond the surface of the die and template member. It is of particular advantage here that these mounting elements are threaded into guide sleeves which in turn are inserted into the die and template member through a self-cutting outer threading. It has to be observed here that the die and template member is preferably made of a synthetic material, for example, of polymetacrylic ester so that it is comparatively simple to obtain a threading through a self-cutting thread of an inserting part.

It can thus be seen that the invention distinguishes among the following elements and components. First, there is a die member, basically of cylindrical or rectangular configuration such that its outer surface delineates the internal contour of the wave guide to be made. This member has lateral or other bores and self-cutting threaded sleeves are threadedly inserted therein. These sleeves will receive (threadedly) positioning members for inserts serving as fittings. These fittings are bolted (temporarily) to the positioning members. All this is assembled prior to electroplating. Once the inserts are embedded in the plating layer that is generated on top of the die and template member, the die member with inserted threaded sleeves and positioning members can be withdrawn to thereby open up the interior of the hollow wave guide just made. Now pins or the like are inserted into the embedded fittings as permanent installations to project into the wave guide for whatever purpose that is desired.

It should be mentioned that the above mentioned U.S. Pat. No. 3,864,688 as well as German Patent Application No. 32 41 890.6 and No. 32 41 889.2 suggests particular wave guide components to be made. The inventive method is particularly advantageously applicable to the making of such parts, but in a simpler manner. In order to make parts of the type disclosed in these references it was found advisable to provide a die and template member which includes at least three parts. Of these three parts, there is a middle or center part with a rectangular or round cross section cooperating with at least two rectangular or elliptically cross sectioned parts which are arranged parallel to each other and to the surface of the middle or central part in a releasable manner. The longitudinal axes of these lateral parts extend transversely to the longitudinal axis of the middle part.

This kind of an arrangement permits particularly uniformity in the manufacture of the desired component through a reusable template and die member and the reusability is directly contributory to the uniformity of the parts that are being made. This involves particularly questions of orientation of the components to be made with regard to the feeding of waves into the wave guide once it has been made. The reusability and reproduceability of the result is therefore directly contributory to optimizing these requirements. After the wave guide element and member has been made through an electrolytical process, the parts will be separated from each other as will be explained more fully below and the separated die member parts are sequentially pulled out of the completed component. After reassembly, they can be again inserted into the electrolytic bath for another coating step which, of course, means the production of another wave guide having exactly the same dimensions and internal orientations as the one which has been previously made.

It is of advantage here to provide the die member or die member assembly such that a basically rectangular part is connected to the front of the middle part and another rectangular part is connected to the cylindrical periphery of the central part whereby the long side of the latter rectangular part runs parallel to the longitudinal axis of the cylindrical center part and the first mentioned part which is connected to the front end of the middle die member has its long side as seen in cross section arranged perpendicularly to the longitudinal axis of the central die part. This particular arrangement of the die and template member and its assembly is very well suited for making components of the type shown in the German application No. 32 41 890.6 and No. P32 41 889.2 which of course employed totally different methods.

If the middle part of a tri-partite die and template member has a round cross section it is of advantage that the supplemental die parts connected to its outer periphery has a curvature which meshes the curvature of this cylindrical middle part and there should be at least one indexing pin traversing the interface by means of which the two parts can be indexed to each other. Here, it is of particular advantage to provide such an indexing pin in the rectangular supplemental part which is inserted in a suitable guide and bore in the middle part. Moreover, this rectangular part should be clamped by means of a bolt to the cylindrical part, the bolt to be inserted into a central bore of the rectangular part that is connected to the peripheral surface of the cylindrical part while suitable threaded bore between or next to the guides is provided in order to accomodate this indexing bolt or pin. Again, this is a feature by means of which it is prevented that electrolytic fluid can penetrate any gap between die member parts and posits metal thereat, which of course would impede easy removal of the die and template member and components thereof after the wave guide has been completed. The indexing pins and the guide and bores provided for them make sure, moreover, that the parts can all be reassembled in exactly the same configuration as originally contemplated while on the other hand separation of these die and template member components is facilitated.

The fastening of the other supplemental rectangular part of the front end of the middle die component is carried out in a similar manner, however, one uses here a threaded bolt which traverses the particular rectangular part. This particular feature can be utilized further in that the free end of this threaded bolt that projects from the rectangular part is furnished with an annular metallic part which in turn is then clamped by means of a nut to the rectangular part from which the the threaded pin projects. This metallic part is now inserted in the plating process and will serve, for example, as a guide for a trim screw or a threaded bolt in the completed wave guide.

Finally, it should be mentioned that the free end of any rectangular part should be provided with a flange which is also subjected to the electroplating procedure, these flanges now made integral with the wave guide proper facilitate the connection of the particular electromagnetic wave guide to other parts.

DESCRIPTION OF THE DRAWINGS

While the specification concludes with claims particularly pointing out and distinctly claiming the subject matter which is regarded as the invention, it is believed that the invention, the objects and features of the invention, and further object features and advantages thereof will better understood from the following description taken in connection the accompanying drawing in which:

FIG. 1 is a cross section through a die and template member constructed in accordance with the preferred embodiment of the present invention for practicing the inventive process and method in a best mode configuration whereby the figure illustrates in a partitioned manner different states in the operation; the left hand portion of FIG. 1 shows the situation of the die and template member prior to the electroplating process and the right hand portion illustrates the almost completed electrogalvanic process, the die and template member being just about ready for removal;

FIG. 2 illustrates a top view of the right hand portion of FIG. 1; and

FIGS. 3 and 4 illustrate side views partially in section of wave guide die members to be used in accordance with the present invention under utilization of appropriately contoured and positioned die and template members which are constructed in order to suit the particular situation and requirement in the process to be performed.

Proceeding now to the detailed description of the drawings, the Figures show, particularly FIG. 1, a die member 1 which is to be made of cylindrical contour and thus establishes basically the internal contour of the wave guide to be made which in this case will be circularly round. Alternatively, the cross section could be elliptical, rectangular or square shaped. This particular die member is made preferably made from polymetacryl ester. The particular die member 1 is provided with a plurality of cylindrical bores 2 in accordance with the requirements of the product to be made.

Threaded sleeves 3 are inserted into these bores whereby particular these sleeves 3 are provided with a self-cutting outer threading so that upon insertion of such a sleeve 3, the bores 2 are provided in addition with a nut-like threading. On the other hand, each of the sleeves 3 is provided with an internal threading and therefore fitting and positioning members 4 can be threadably inserted into these sleeves 3. These positioning members 4 should, as far as their outer surfaces are concerned, be flush with the outer cylindrical periphery of the die and template member 1 or should be inserted somewhat into the interior of this overall cylindrical contour. In other words, the positioning members 4 should not project from the surface of the member 1. Guide members 4 are provided with internal bores into which indexing pins or threaded bolts 6 can be inserted. Members 4 and 3 are, in a sense, part of the die template assembly. A particular metallic fitting 7 is now placed on such an indexing pin 6 and is clamped to the surface of the die and template member 1 by means of a nut 8. A cover 7*a* is provided between the surface of this metallic insert and fitting 7 and the screw 8, the surface particularly facing away from the die member 1. This cover is to prevent precipitation of electrolytic material upon that particular portion which in this case is the small side of the trapezoidal contour of the fitting member 7. Insert 7 is elongated, but requires for fastening just one cylindrical mounting and positioning member 4.

The surface portion of fitting 7 facing and abutting the die member of 1 is matched in curvature to the die member 1 in an optimizing fashion so that during the subsequent electrolytic process penetration of electrolytic fluid into any gap between parts 1 and 7 is avoided. Contour matching here simply prevents a formation of such a gap.

The surface of the die member 1 itself is provided with an electrically conductive layer or coating such that positive contact will be established to the metallic insert and fitting members 7. It may be of advantage to provide this electrically conductive layer upon the part 1 just prior to assembly so that upon insertion of the supplemental fitting member 7 the electrical contact with the conductive layer just made is established immediately.

It can thus be seen that in this manner any suitable number of supplemental members and elements can be attached to the central die member 1. The thus prepared die with supplemental assembly is now inserted into an electrolytic liquid and is electrically connected through the electrolysis system such that the member 1 (i.e. its electrically conductive coating) and all parts electrically connected to it (such as 2 and 7) serve as a cathode. As a consequence of the now ensuing electrolytic process, metal precipitates upon the surface of the member 1 which in effect causes an inherent inclusion of the fitting 7 into the resulting metal layer 9. Due to the high electrical conductivity which a wave guide must possess, it is suggested to use copper as the precipitating metal from which the wave guides will then be made. The metallic insert and fitting 7 is preferably made of brass because that particular kind of material is particularly suitable for milling and cutting operations. However, as far as the method of the invention is concerned, this restriction is not to be understood as a mandatory requirement. One can use other materials, provided that their electrical conductivity is sufficiently high. The indexing pins in bolt 6 as well as the fastening screw and nut 8 are preferably made of high grade steel, preferably stainless steel should be employed.

After the electrolytic process has proceeded to a sufficient degree, that means after the layer 9 has obtained the desired thickness, the part is removed from the electrolytic bath. Now, the nuts 8 as well as the indexing pins or bolts 6 are removed so that the die 1 can in fact be removed from the hollow and galvanically or electrolytically manufactured products. One will obtain in this manner a tubular member which includes in exactly reproducible locations and under exactly the same angle guide members 10 for the insertion of short-circuiting and trimming pins or bolts and the like whereby particularly the guide 10 for these trimming and adjusting pins are galvanically inserted in the product. Such mounting elements 10 are composed essentially of the initial members 7 as now embedded in electrolytically precipitated material 9. These elements 10 will then receive in a conventional manner the requisite indexing and trimming pins and bolts, etc. are to be the operative elements that project into the wave guides. These elements in turn will be fixed and secured to these guides and fittings 10 by means of soldering.

After having described the invention in principle and on the basis of a fairly simple die and template configuration, reference is now made to a more complex configuration. FIG. 3 illustrates a die and template member which is comprised of three parts 1*a*, 1*b* and 1*c*. Herein, the central 1*a* is preferably made of a cylindrical configuration whereas the parts 1*b* and 1*c* are both of rectangular cross section. The parts 1*b* and 1*c* are releasably connected to the part 1*a*. For this indexing pins 11 are centrally inserted in the central and middle part 1*a* and as was described earlier they are secured thereto through threaded insertions. The indexing pins 11 extend from the axial front end of the middle part 1*a* and are inserted in correspondingly matching bores 12 of the part 1*c*. A threaded bolt is run through the part 1*c* and threaded into a threading 14 provided in and near the front end surface of the middle part 1*a*. The free end of the bolt 13 now receives a metallic fitting 15 which is placed thereupon and which is to be galvanically inserted in the wall of the part to be made through the electrolytic process. Clamping of the parts 1*a* and 1*c* together is carried out through a nut 16.

The parts 1*a* and 1*b* are interconnected in similar fashion. The indexing pins 11 here are provided in the front end of the part 1*b* and extend therefrom for being received in fitting bores 12 which are worked into the interior of the part 1*a* through its cylindrical surface. The clamping connection of the parts 1*a* and 1*b* to each other is carried out through a threaded pin 13*a* which runs through a radial bore in the middle part 1*a*. A metallic fitting 17 is stuck onto the end of the bolt 13*a* which projects from the part 1*a* and this fitting 17 is clamped by means of a nut 18 to the cylindrical surface of the middle die and template member 1*a*. The part 1*b* itself can be analogously clamped to the part 1*a* through a threaded nut which is not illustrated.

The free ends of the part 1*b* and 1*c* receive flange disks 19 and 10 respectively and by means of an electrically conductive paste one will fill any space or cavity between the disks 19 and 20 on the one hand the parts 1*b* and 1*c* on the other hand. This way one will not encounter any difficulties in the electroplating of the flange 19 and 20 into the assembly. Another metallic member 21 may be fastened to the member 1*a* additionally and in the same manner as was described with reference to FIGS. 1 and 2 for inserting it into the wall that is generated through the electroplating process.

Prior to the electrolytic operation, the surfaces of the part 1*a*, 1*b* and 1*c* are rendered electrically conductive whereby the front ends of the parts 1*b* and 1*c*, i.e. the flange area and zone is covered acccordingly. Analogously, one will cover that part of the cylindrical member 1*a* which faces away from the part 1*c*. In other words, the opposite end of the cylindrical member 1*a* is covered so as to avoid a direct formation of an electrolytic closure.

After the electrolytical process has been completed the bolt 13*c* is released and the part 1*b* is removed. Thereafter, one will release the bolt 13 so that the middle part 1*a* can be removed from the galvanically made wave guide. Finally, the parts 1*c* is removed laterally from the wave guide.

As a consequence of the foregoing procedure a hollow member is made by galvanic and electrolytic process which has two feed inputs formed by the parts that contoured around die members 1*b* and 1*c*. Moreover, these feeding inputs are exactly transverse to the longitudinal axis of the cylindrical die member 1*a* which of course is the axis of the cylindrical wave guide thus made. The die parts 1*b* and 1*c* have preferably rectangular cross section and as far as their axes are concerned, they are 90° out of phase with respect to each other and with respect to their fastening to the part 1*a*.

The metallic fittings 15, 17 and 21 and other parts that may be provided in an analogous manner have been galvanically and electrolytically inserted in the wall which has been made and these parts of course, serve for receiving trimming disks or pins, short-circuiting pins and etc. The front end of cylindrical part 1*a*, opposite the part 1*c* may be provided, for example, with additional parts such as flared end 1*d* which, for example, serve for the formation of a feed horn or the like or of a transition from a rectangular cross section to a round cross section or vice versa as far as a wave guide is concerned.

The thus made wave guide element will now be provided with short-circuiting pins, trimming bolts, and so forth in accordance with the electrical requirements by insertion into the metallic fittings 15, 17 and 21 which have been provided for that purpose and these trimming disks and short-circuiting pins, etc., will then be soldered to the parts 15, 17 and possibly others.

Turning now to FIG. 4 this particular embodiment illustrates an alternative way of fastening the die and template member 1*b* to the member 1*a* in a different manner. In this case, a threaded pin 13*b* is provided with a guide portion 12*a* which runs through guide and fitting bores of the parts 1*a* and 1*b* which are not illustrated further. The threaded pin 13*b* will then be threaded into a part or threaded fitting which has been inserted in the part 1*b*. This is likewise not shown in FIG. 4 but is quite analogous to the formation of a fitting sleeve that was described with reference to FIG. 1. The front end of part 1*b* which should be matched to the curvature of the cylindrical portion of member 1*a* which, of course, serves also the purpose of providing a particular orientation. The parts 1*a* and 1*b* are then clamped together through the threaded nut 18.

The invention is not limited to the embodiments described above but all changes and modifications thereof not constituting departures from the spirit and scope of the invention are intended to be included.

We claim:

1. Method of making a wave guide with components which will extend into the interior of the wave guide comprising the steps of:

providing a cylindrical die and template member;

releasably fastening fittings having cross section of a trapezoidal contour, and having bores, to the die member at particular locations of the die member, these fittings as well as the surface of the die member being electrically conductive;

inserting the thus assembled die into an electrolytic bath and connecting it to assume cathodic potential so as to obtain electrolytic plating and depositing whereby the fittings become embedded into the wall of the thus electrolytically generated part;

removing the die from the electrolytically generated part; and inserting pins into the bores of the embedded fittings to reach into the interior of the hollow wave guide thus made.

2. Method as in claim 1 wherein the fittings are fastened to the die member through indexing pin means passing through the fitting analogously to subsequent insertion of component parts.

3. Method as in claim 1 wherein the fittings have surfaces not engaging the die members with surfaces being at least covered in part through an electrically not conductive material.

4. Method as in claim 1 wherein the fittings are clamped securely to the surface of the die member.

5. Method as in claim 2 wherein the die member is provided with threaded bores for receiving fastening bolts upon which in turn are placed the fittings, the fittings respectively tightened to the surface of the die member through nut means threaded onto the threaded pins.

6. Method as in claim 1 wherein said fittings have surface portions for engaging the surface of the die member, the surface portion of the fittings contour matching the surface of the die member.

7. Method as in claim 1 and including the step of threading sleeves into the die member, threading mounting members into the sleeves and indexing pins into such members and placing said fittings onto the pin means and fastening them thereto.

8. A die and template member for use in an electrolytic plating and manufacturing process for making a wave guide, the die and template member havaing a particular surface and comprising a plurality of mounting members inserted in said die member and not projecting beyond the surface thereof;

pin means respectively inserted in said mounting members and projecting beyond the surface of the die member; and fitting members placed onto said pin means and being fastened to the die member to be partially embedded in the electrolytically generated walls for the wave guide to be made.

9. Die and template member as in claim 8 wherein said mounting members are threaded into sleeves having outer threadings and are threaded into the die member.

10. Die and template member as in claim 8 being composed of at least three parts, a central part with rectangular a round cross section and two supplemental parts with rectangular or elliptical cross section being releasably secured to different portions of the metal part such that their respective longitudinal axes extend vertically to the longitudinal axes of the middle part.

11. Die and template member as in claim 10 wherein one of the supplemental parts is secured to the front and the middle part and at least one other supplemental part is fastened to the other surface of the other part.

* * * * *